US012276424B1

(12) United States Patent
Weaver et al.

(10) Patent No.: US 12,276,424 B1
(45) Date of Patent: Apr. 15, 2025

(54) FUEL NOZZLE HAVING INNER AND OUTER MIXING CHAMBERS FED WITH FUEL VIA FIRST AND SECOND HOLE PATTERNS

(71) Applicant: Honeywell International Inc., Charlotte, NC (US)

(72) Inventors: Joshua J. Weaver, Yorktown, IN (US); Curtis L. Taylor, Paradise Valley, AZ (US); Edward Lovett, Parker City, IN (US); Bradley M. Wright, Hartford City, IN (US)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 18/377,776

(22) Filed: Oct. 7, 2023

(51) Int. Cl.
*F23R 3/28* (2006.01)
*F23R 3/14* (2006.01)
*F23R 3/34* (2006.01)

(52) U.S. Cl.
CPC ..... *F23R 3/286* (2013.01); *F23R 3/14* (2013.01); *F23R 3/343* (2013.01)

(58) Field of Classification Search
CPC ..... F23R 3/14; F23R 3/286
See application file for complete search history.

(56) References Cited

U.S. PATENT DOCUMENTS 5,360,166 A 11/1994 Nogi et al.
5,407,347 A 4/1995 Bortz
5,435,126 A 7/1995 Beaudoin
5,511,375 A * 4/1996 Joshi ..... F23R 3/36 60/737
5,647,739 A 7/1997 McDonald
5,879,148 A 3/1999 Cheng et al.
2012/0052451 A1 3/2012 Bathina et al.
2012/0312890 A1 12/2012 Romig
2017/0219210 A1* 8/2017 Ogrowsky ..... F23R 3/28
(Continued)

FOREIGN PATENT DOCUMENTS

CA 2782477 4/2015
WO 2009047338 A2 4/2009

*Primary Examiner* — William H Rodriguez
(74) *Attorney, Agent, or Firm* — Ortiz & Lopez, PLLC; Kermit D. Lopez; Luis M. Ortiz

(57) ABSTRACT

A fuel nozzle and a method of operating the fuel nozzle, can include a group of chambers located in the fuel nozzle, wherein the chambers can include an inner mixing chamber and an outer mixing chamber. The inner mixing chamber and the outer mixing chamber each can accept air and fuel separately and combine the air and the fuel to form a mixture of the air and the fuel. A first hole pattern and a second hole pattern can be configured in the fuel nozzle, wherein the fuel enters the inner mixing chamber through the first hole pattern and enters the outer mixing chamber through the second hole pattern. Furthermore, an angled discharge can be included with the inner mixing chamber, wherein the angled discharge slows an exit velocity of the mixture of the air and the fuel prior to exiting the fuel nozzle through a discharge end of the fuel nozzle. The group of chambers together with the first hole pattern and the second hole pattern and the angled discharge can facilitate stabilization of a flame at two distinct points downstream of the fuel nozzle depending on the rate of flow of the fuel and the air.

18 Claims, 3 Drawing Sheets

(56) References Cited

U.S. PATENT DOCUMENTS

| | | | | |
|---|---|---|---|---|
| 2018/0298824 | A1* | 10/2018 | Matsuyama | F23R 3/343 |
| 2019/0257520 | A1* | 8/2019 | Tibbs | F23R 3/14 |
| 2020/0003421 | A1* | 1/2020 | Sanchez | F23D 11/107 |
| 2022/0003167 | A1* | 1/2022 | Shershnyov | F23R 3/16 |
| 2022/0003415 | A1* | 1/2022 | Shershnyov | F23D 14/70 |
| 2022/0018542 | A1* | 1/2022 | Chon | F23R 3/14 |
| 2022/0120222 | A1* | 4/2022 | Watase | F23R 3/28 |
| 2022/0268213 | A1* | 8/2022 | Morenko | F23R 3/12 |
| 2023/0194093 | A1* | 6/2023 | Bucaro | F23R 3/36 60/737 |
| 2024/0044293 | A1* | 2/2024 | Snyder | F02C 9/40 |
| 2024/0183536 | A1* | 6/2024 | Bucaro | F23D 11/107 |

* cited by examiner

FUEL NOZZLE HAVING INNER AND OUTER MIXING CHAMBERS FED WITH FUEL VIA FIRST AND SECOND HOLE PATTERNS

TECHNICAL FIELD

Embodiments are generally related to industrial burner technologies. Embodiments further relate to low emission burners used in industrial applications. Embodiments further relate to fuel nozzles utilized in burners.

BACKGROUND

Some industrial single burner applications require a high amount of thermal turndown to provide a required operational performance (e.g., air heating, thermal oxidizers etc.). Thermal turndown in a single burner industrial process is often limited by the burner. Traditional industrial burners in these applications may operate with a thermal turndown of, for example, 50:1 (e.g., ratio of maximum capacity to minimum capacity). This level of turndown allows these processes to operate with flexibility in throughput and operating conditions. Low emissions industrial burners, however, commonly cannot meet this level of thermal turndown. The emissions reduction techniques employed in these burners often limit their window of stable fuel and air ratios, as well as their thermal turndown.

With increasing restrictions on NOx and CO emission levels, low emission burners are becoming increasingly prominent. Users and customers often do not have a choice but to accept the reduction in thermal turndown to meet the emissions requirements. If an industrial burner could be designed in such a manner as to maintain as much flexibility as possible, while still generating ultra-low NOx and CO emissions, this would offer a significant advantage over conventional approaches.

BRIEF SUMMARY

The following summary is provided to facilitate an understanding of some of the features of the disclosed embodiments and is not intended to be a full description. A full appreciation of the various aspects of the embodiments disclosed herein can be gained by taking the specification, claims, drawings, and abstract as a whole.

It is, therefore, one aspect of the embodiments to provide for improved burner technologies capable of being used in industrial and other applications.

It is another aspect of the embodiments to provide for an improved lower emission burner.

It is yet another aspect of the embodiments to provide for an improved fuel nozzle utilized in burners.

It is also an aspect of the embodiments to provide for a low emission swirl fuel nozzle.

It is a further aspect of the embodiments to provide for a method of operation a low emission swirl fuel nozzle.

The aforementioned aspects and other objectives can now be achieved as described herein. In an embodiment, a fuel nozzle can include: a plurality of chambers located in the fuel nozzle, wherein the plurality of chambers includes an inner mixing chamber and an outer mixing chamber, wherein the inner mixing chamber and the outer mixing chamber each accept air and fuel separately and combine the air and the fuel to form a mixture of the air and the fuel; a first hole pattern and a second hole pattern formed in the fuel nozzle, wherein the fuel enters the inner mixing chamber through the first hole pattern and enters the outer mixing chamber through the second hole pattern; and an angled discharge included with the inner mixing chamber, wherein the angled discharge slows an exit velocity of the mixture of the air and the fuel prior to exiting the fuel nozzle through a discharge end of the fuel nozzle, wherein the plurality of chambers together with the first hole pattern and the second hole pattern and the angled discharge facilitates stabilization of a flame at two distinct points downstream of the fuel nozzle depending on a rate of a flow of the fuel and the air.

In an embodiment, the outer mixing chamber can include a combination of spaces created between a plurality of vanes and an air housing.

In an embodiment, the plurality of vanes can be located at an angle from a long axis of a burner to generate a swirling flow at the discharge end of the fuel nozzle.

In an embodiment, a plurality of vanes can be located at an angle from a long axis of a burner to generate a swirling flow at the discharge end of the nozzle.

In an embodiment, the fuel can enter the fuel nozzle through a fuel inlet and proceed to the inner mixing chamber where it is distributed to the inner mixing chamber and outer mixing chamber simultaneously.

In an embodiment, the fuel enters the inner mixing chamber through the first hole pattern in a desired amount and velocity.

In an embodiment, the fuel can enter the outer mixing chamber through the second hole pattern in a desired amount and velocity.

In an embodiment, the is swirl stabilized downstream from the fuel nozzle.

In an embodiment, as a capacity of the fuel is reduced the flame shifts stabilization immediately downstream from the discharge end of the fuel nozzle.

In an embodiment, a fuel nozzle can include: a plurality of chambers located in the fuel nozzle, wherein the plurality of chambers includes an inner mixing chamber and an outer mixing chamber, wherein the inner mixing chamber and the outer mixing chamber each accept air and fuel separately and combine the air and the fuel to form a mixture of the air and the fuel; and an angled discharge included with the inner mixing chamber, wherein the angled discharge slows an exit velocity of the mixture of the air and the fuel prior to exiting the fuel nozzle through a discharge end of the fuel nozzle, wherein the plurality of chambers and the angled discharge facilitates stabilization of a flame at two distinct points downstream of the fuel nozzle depending on a rate of a flow of the fuel and the air.

In an embodiment, the first hole pattern and the second hole pattern can be configured from the fuel nozzle, wherein the fuel enters the inner mixing chamber through the first hole pattern and enters the outer mixing chamber through the second hole pattern.

In an embodiment, a method of operating a fuel nozzle can involve the steps or operations of: accepting air and fuel separately in an inner mixing chamber and an outer mixing chamber of a plurality of chambers located in a fuel nozzle; combining the air and fuel to form a mixture of the air and the fuel, wherein the fuel enters the inner mixing chamber through a first hole pattern formed in the fuel nozzle and enters the outer mixing chamber through a second hole pattern formed in the fuel nozzle; and slowing with an angled discharge included with the inner mixing chamber, an exit velocity of the mixture of the air and the fuel prior to exiting the fuel nozzle through a discharge end of the fuel nozzle.

In an embodiment of the method, the plurality of chambers together with the first hole pattern and the second hole pattern and the angled discharge can facilitate stabilization of a flame at two distinct points downstream of the fuel nozzle depending on a rate of a flow of the fuel and the air.

In an embodiment of the method, the outer mixing chamber can comprise a combination of spaces created between a plurality of vanes and an air housing.

In an embodiment of the method, the plurality of vanes can be located at an angle from a long axis of a burner to generate a swirling flow at the discharge end of the fuel nozzle.

An embodiment of the method can further involve generating a swirling flow at the discharge end of the nozzle with a plurality of vanes located at an angle from a long axis of a burner.

In an embodiment of the method, the fuel can enter the fuel nozzle through a fuel inlet and can proceed to the inner mixing chamber where it is distributed to the inner mixing chamber and outer mixing chamber simultaneously.

In an embodiment of the method, the fuel can enter the inner mixing chamber through the first hole pattern in a desired amount and velocity.

In an embodiment of the method, the fuel can enter the outer mixing chamber through the second hole pattern in a desired amount and velocity.

In an embodiment of the method, the flame can be swirl-stabilized downstream from the fuel nozzle, and furthermore, as the capacity of the fuel is reduced, the flame can shift stabilization immediately downstream from the discharge end of the fuel nozzle.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the principles of the embodiments.

In the drawings described and illustrated herein, identical or similar parts and elements are generally indicated by identical reference numerals.

DETAILED DESCRIPTION

Figure 1:
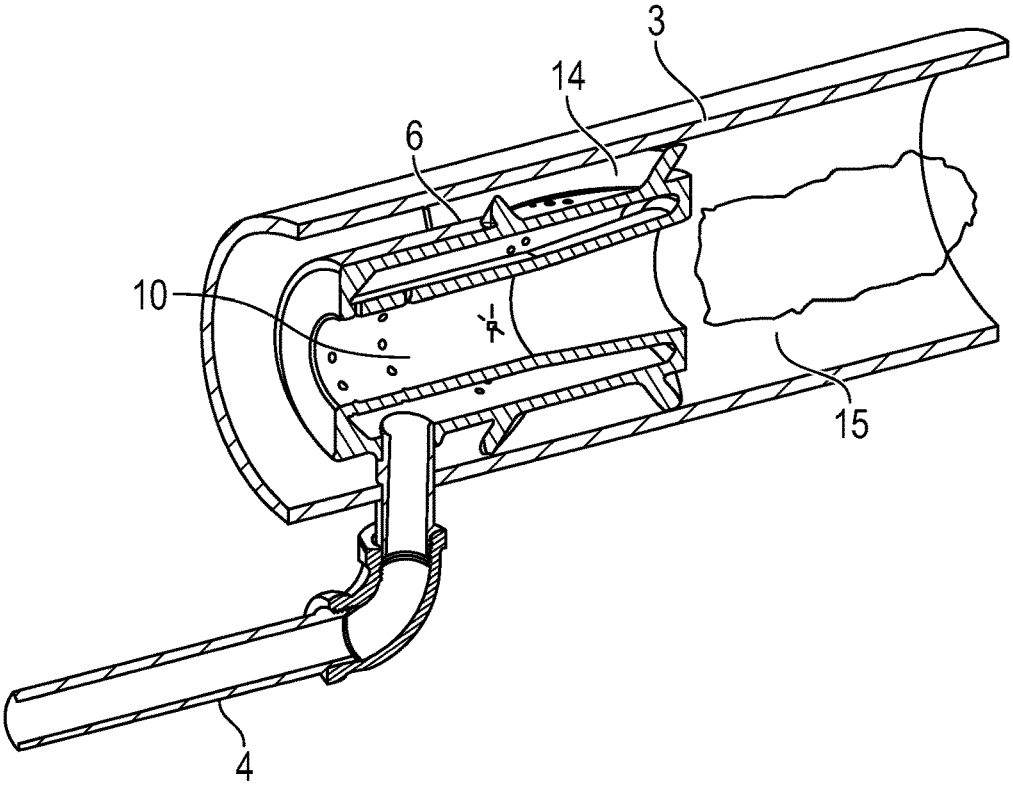
FIG. 1 illustrates a cross-sectional view of an air housing and a fuel nozzle located therein, which may be implemented in accordance with an embodiment.

The particular values and configurations discussed in these non-limiting examples can be varied and are cited merely to illustrate one or more embodiments and are not intended to limit the scope thereof.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other issues, subject matter may be embodied as methods, devices, components, or systems. Accordingly, embodiments may, for example, take the form of hardware, software, firmware, or a combination thereof. The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein may not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Generally, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

The disclosed embodiments pertain to a fuel nozzle design featuring several key components including the use of multiple chambers and hole patterns. That is, the fuel nozzle can contain various chambers, including an inner mixing chamber and an outer mixing chamber. These chambers can separately accept air and fuel and combine them to create a mixture of air and fuel. The fuel nozzle can be configured to include at least two distinct hole patterns: the first hole pattern can allow fuel to enter the inner mixing chamber, while the second hole pattern can direct fuel into the outer mixing chamber.

As will be discussed in more detail, another key component of the fuel nozzle includes the use of an angled discharge. That is, inside the inner mixing chamber, an angled discharge mechanism can be implemented. This component can serve to reduce the exit velocity of the air-fuel mixture just before it exits the fuel nozzle through its discharge end. This reduction in velocity can aid in stabilizing the flame downstream of the nozzle. Depending on the rate of fuel and air flow, the flame can stabilize at two distinct points downstream of the nozzle.

The fuel nozzle can also incorporate the use of an outer mixing chamber design. The outer mixing chamber can be created by the arrangement of vanes and an air housing. The vanes may be angled relative to the long axis of the burner to induce a swirling flow at the nozzle's discharge end. The fuel nozzle further can implement a swirling flow generation. In addition to the outer mixing chamber design, a plurality of vanes is placed at an angle from the long axis of the burner to generate a swirling flow at the discharge end of the nozzle.

Other components of the fuel nozzle can include a unique fuel entry feature, wherein fuel can enter the fuel nozzle through a fuel inlet. The fuel can be then distributed to both the inner mixing chamber and the outer mixing chamber simultaneously. The fuel entering the inner mixing chamber can do so in a specific amount and at a specific velocity through the first hole pattern, while fuel entering the outer mixing chamber can follow a similar controlled pattern through the second hole pattern.

The design of the disclosed fuel nozzle can contribute to swirl-stabilized flames downstream from the nozzle, which can enhance combustion efficiency and control. Interestingly, as the fuel capacity can be reduced, and the flame can shift its stabilization point immediately downstream from the discharge end of the fuel nozzle. The disclosed embodiments thus relate to an improved fuel nozzle with carefully engineered components and designs that can optimize the mixture of air and fuel, control combustion, and stabilize the flame under various operating conditions.

FIG. 1 illustrates a cross-sectional view of an air housing 3 and a fuel nozzle 6 located therein, which may be implemented in accordance with an embodiment. The fuel nozzle 6 shown in FIG. 1 is depicted as enclosed within or by an air housing 3 such that air can pass through an inner chamber 10 and an outer chamber 14. A stabilization point 15 is shown at the right hand side of the air housing 3. FIG. 1 also depicts a fuel inlet 4 through fuel can enter. The fuel nozzle 6 can function as a low emission swirl fuel nozzle.

Figure 2:
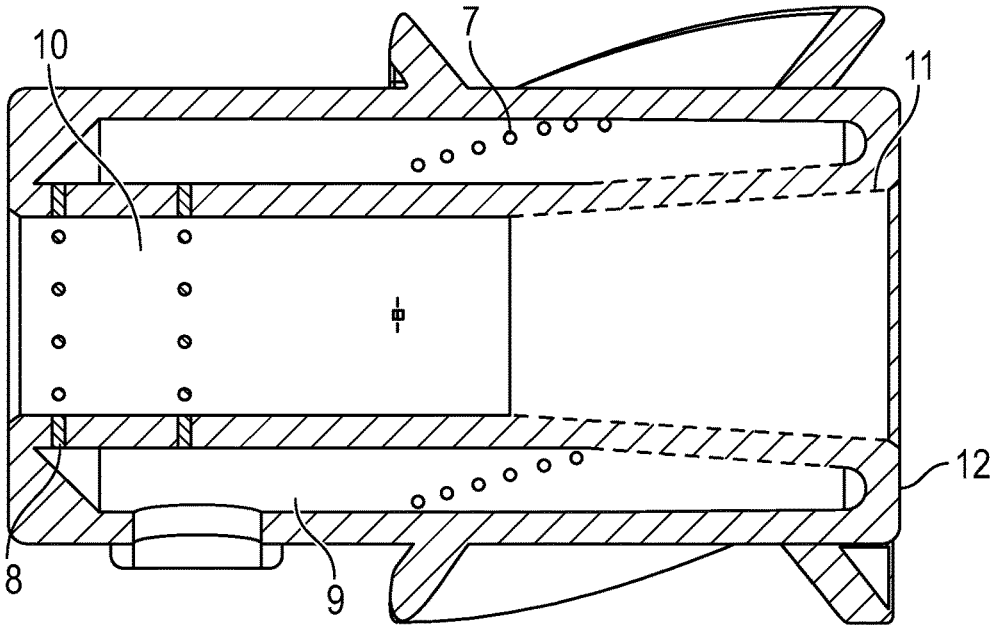
FIG. 2 illustrates a cross-sectional view of the fuel nozzle only, in accordance with an embodiment.

FIG. 2 illustrates a cross-sectional view of the fuel nozzle 6 only, in accordance with an embodiment. As shown in FIG. 2, fuel can enter the inner chamber 10 through a hole pattern 8 in a desired amount and velocity. Furthermore, fuel can enter the outer chamber 14 through the hole pattern 7 in a desired amount and velocity. FIG. 2 also depicts a discharge end 12 shown at the right side of the figure. In addition, FIG. 2 depicts a common fuel chamber 9 for the hole patterns 8 and 7.

Figure 3:
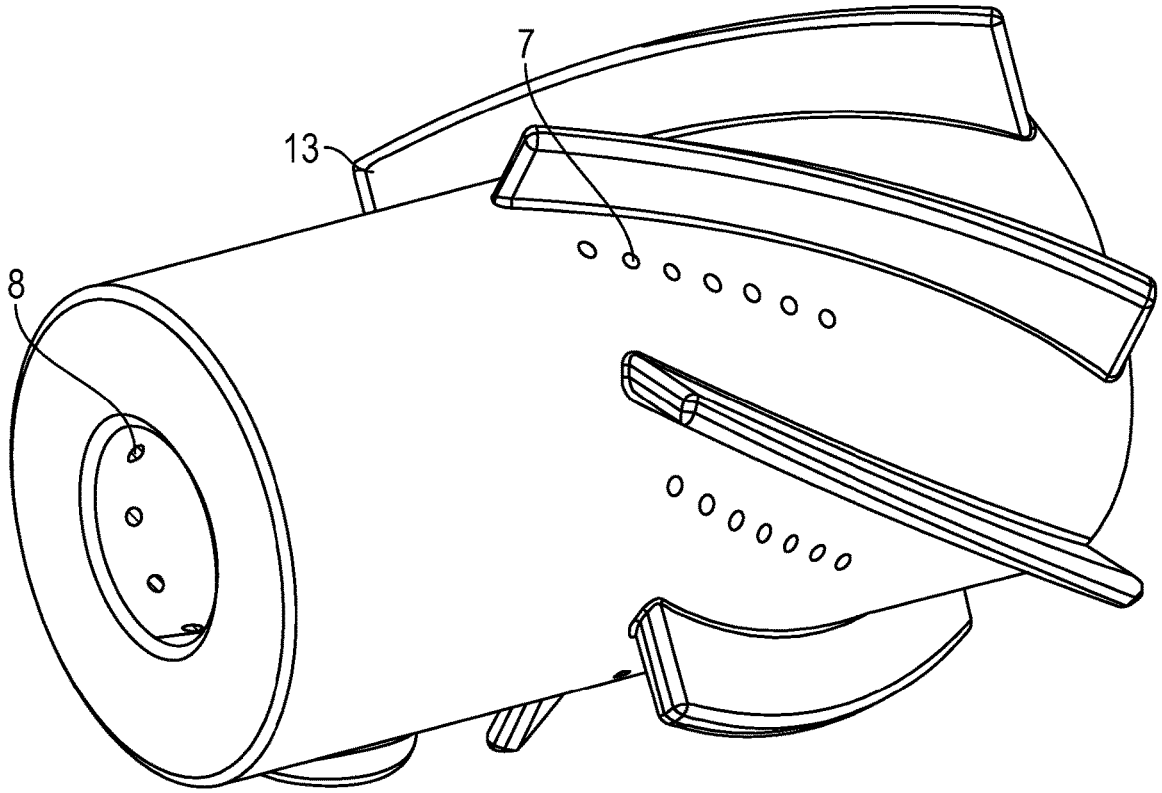
FIG. 3 illustrates a perspective view of the fuel nozzle shown in FIG. 1 and FIG. 2, in accordance with an embodiment.

FIG. 3 illustrates a perspective view of the fuel nozzle 6 shown in FIG. 1 and FIG. 2, in accordance with an embodiment. A hole pattern 8 is shown at the left side of the figure. The fuel nozzle 6 can include one or more vanes such as the vane 13 shown in FIG. 3.

Figure 4:
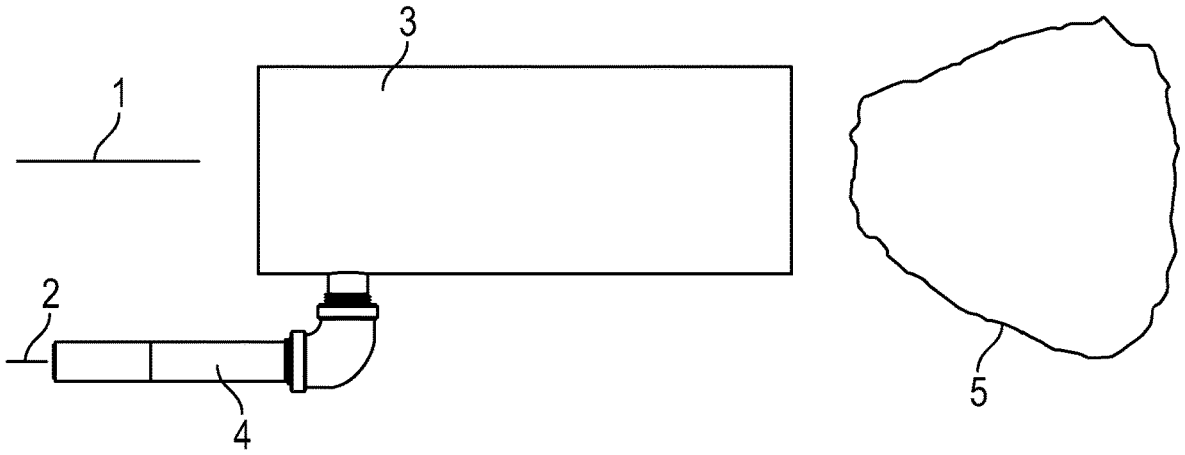
FIG. 4 illustrates a side view of the air housing with respect to a flame, in accordance with an embodiment.

FIG. 4 illustrates a side view of the air housing 3 with respect to a flame, in accordance with an embodiment. In general, the fuel nozzle 6 can be is enclosed in the air housing 3 such that air 1 passes through the inner chamber 10 and the outer chamber 14. The inner chamber 10 has the has angled discharge 11, which can slow the exit velocity of the air and fuel mixture prior to exiting the fuel nozzle through the discharge end 12. The outer chamber 14 is the combination of the spaces created between the vane(s) 13 and the air housing 3. These vanes can be set at a specified angle from the long axis of the burner to generate the swirling flow at the discharge end 12 of the fuel nozzle. The fuel 2 enters through the fuel inlet 4 and proceeds to the inner fuel chamber 9 where it is distributed to the two chambers 10 and 14 simultaneously.

Fuel can enter the inner chamber 10 through the hole pattern 8 in the desired amount and velocity. Fuel enters the outer chamber 14 through hole pattern 7 in the desired amount and velocity. At nominal capacity the flame is swirl stabilized downstream of the nozzle 5. As the capacity is reduced, the flame shifts 15 to being stabilized immediately downstream from the nozzle discharge end 12. The stabilization point 15 may be similar to other nozzle mix style burners in that the flame can be anchored just downstream of the fuel nozzle and will not stabilize behind the fuel nozzle, thereby damaging it.

The embodiments relate to a unique fuel nozzle which can provide ultra-low NOx and CO emissions, while still maintaining flexibility in fuel and air ratio and thermal turndown. This can be accomplished through the implementation of a multi-chambered design that creates two flame fronts which can alternate in dominance depending on the firing rate (or capacity). At higher firing rates the outer chamber has sufficient air flow rate to establish a swirl stabilized flame. At lower firing rates the flame front can move immediately downstream of the nozzle face and can be predominantly stabilized by the flow from the inner chamber. Each chamber can be designed such that the fuel and air ratio in those chambers cannot stabilize a flame alone.

A flame may be only stabilized when the outlets from both chambers are combined is a flame stabilized. This situation can lead to a very stable combustion, similar to a nozzle mix burner, where the flame cannot flash back into the burner internals and cause damage. The multi-chamber design can combine stability and flexibility with low emissions. Note that some conventional technologies may employ a multi-chambered fuel nozzle design that may also increase thermal turndown by providing a secondary flame stabilization point. In these types of devices, however, the flame moves to the first chamber only at low fuel flow rates and high air flow rates. The embodiments disclosed herein differ in both shape and flame stabilization technique from these types of devices. That is, in these conventional devices, there is no swirling flow induced, and the flame is surrounded by penetrations for air flow at low fuel flow rates and high air flow rates. The geometric differences create an entirely different flame dynamic when compared to that of the disclosed embodiments.

Some conventional devices may also include swirler geometry that create a swirl stabilized flame with an inner and outer annulus, swirl blades, and a flow balancing insert in the inner annulus. These types of devices may include parameters responsible for creating a "divergent flow", or a swirl stabilizing flame. These devices, however, are swirlers only, and not a fuel nozzle such as fuel nozzle 6. These types of conventional devices are designed to accept a stream of premixed fuel and air.

The embodiments, on the hand, can accomplish a swirl stabilized flame using the fuel nozzle 6, which accepts air flow and injects the fuel into the air stream in a predefined a pattern, velocity, and proportion. The swirlers used in conventional devices accept a premixture of fuel and air and create swirling flow through mechanical means. The embodiments are further different from these conventional technologies by controlling how the fuel is injected into the air stream, the distribution pattern of the fuel, and by introducing the multi-chambered design the overall proportion of fuel in each chamber is controlled to create the effects described above (i.e., low emissions with high thermal turndown).

Implementation of the fuel nozzle 6 with a burner (e.g., an industrial burner) offers several significant advantages, particularly in terms of environmental sustainability, operational efficiency, and cost savings. Advantages of the fuel nozzle 6 include reduced emissions and improved combustion efficiency. Regarding reduced emissions, a primary advantage of using the low emission swirl fuel nozzle 6 is the significant reduction in harmful emissions such as nitrogen oxides (NOx), carbon monoxide (CO), and particulate matter (PM). This reduction in emissions can help industries meet stringent environmental regulations and reduce their carbon footprint, contributing to cleaner air and a healthier environment.

Swirl fuel nozzles are designed to create a controlled, swirling airflow within the combustion chamber. This enhanced mixing of air and fuel leads to more efficient and complete combustion, maximizing heat transfer and energy conversion. Improved combustion efficiency translates into lower fuel consumption and reduced operating costs.

Another advantage of the fuel nozzle 6 involves the production of a stable flame. The swirl fuel nozzle 6 can promote flame stability, even in challenging conditions such as low fuel flow rates or varying fuel compositions. This stability can ensure continuous and reliable combustion, thereby reducing the risk of flameout and downtime. A further advantage of the fuel nozzle 6 is its flexibility and versatility. The low emission swirl fuel nozzle 6 is adaptable to various fuel types and compositions, making it versatile for use in a wide range of industrial applications. This flexibility can allow industries to switch between different fuels, including cleaner alternatives like natural gas or biofuels, as needed.

The fuel nozzle 6 may also lead to reduced maintenance. That is, the improved combustion efficiency and stable flame provided by the swirl fuel nozzle 6 may result in less wear and tear on burner components. This can lead to longer equipment lifespans and reduced maintenance requirements, saving both time and money. Fuel nozzle 6 also offers the advantage of energy savings. Enhanced combustion efficiency directly correlates with energy savings. Industries can reduce their fuel consumption while achieving the same heat output, leading to lower energy costs and increased competitiveness.

The fuel nozzle 6 is also helpful for meeting regulatory compliance. Many regions have strict emissions regulations that must be met by industrial facilities. Implementing the low emission swirl fuel nozzle 6 may ensure compliance with these regulations, avoiding potential fines and penalties.

Further advantages offered by the fuel nozzle 6 include heat transfer optimization and enhanced process control. Regarding heat transfer optimization, the swirl fuel nozzle 6 can improve heat transfer within the combustion chamber, which is crucial in processes where heat is required, such as in industrial furnaces and boilers. This results in faster heat-up times and more uniform temperature distribution. The swirl fuel nozzle 6 also offers greater control over combustion processes. In addition, advanced control systems may be used to adjust air-fuel ratios and other parameters in real-time, thereby optimizing combustion for changing operational conditions and load demands.

Implementing the low emission swirl fuel nozzle 6 with an industrial burner can provide a holistic set of advantages, ranging from emissions reduction and enhanced efficiency to cost savings and regulatory compliance. These benefits make it a compelling choice for industries looking to improve their environmental performance and operational efficiencies while remaining competitive in today's environmentally conscious world.

Figure 5:
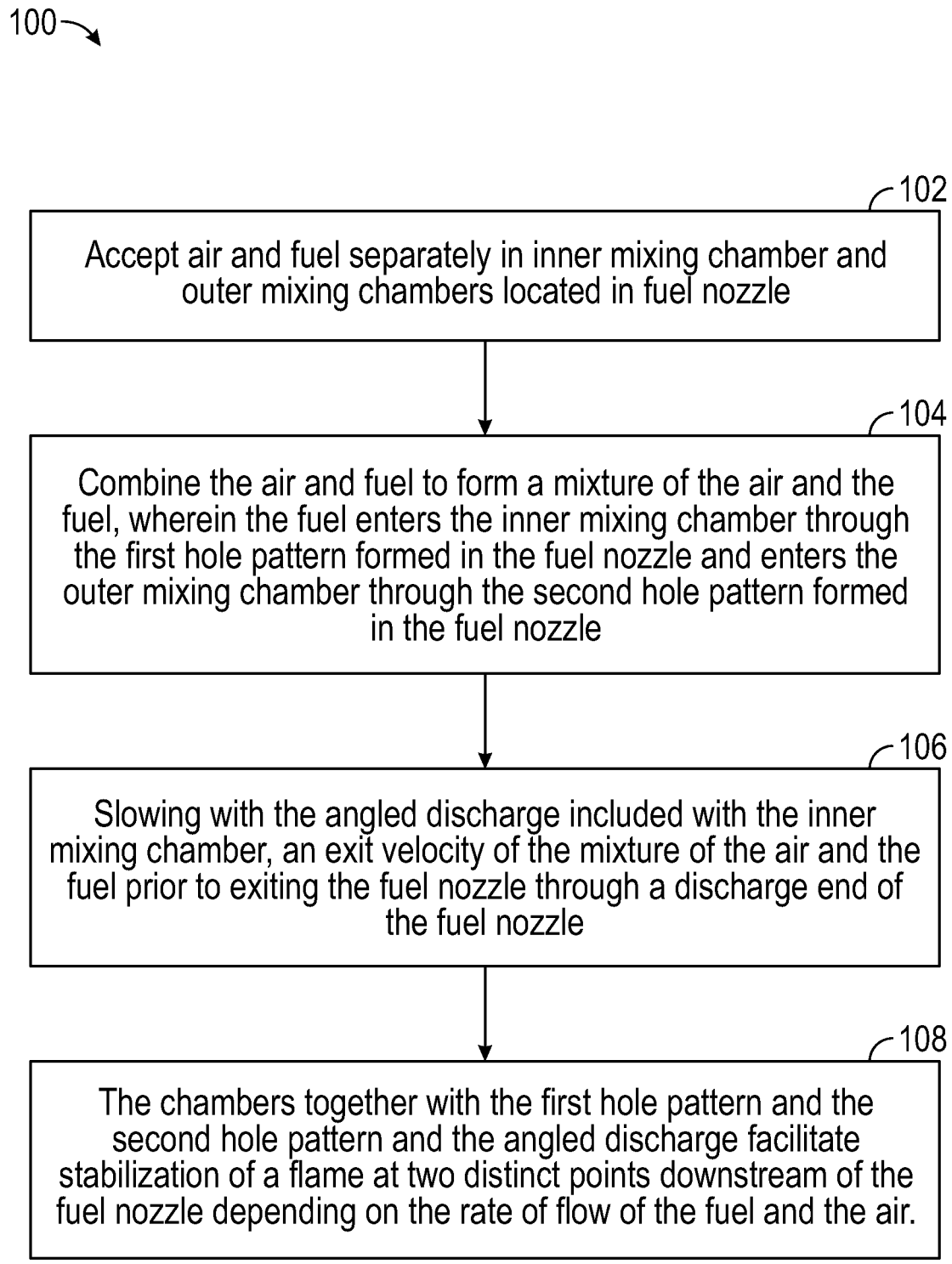
FIG. 5 illustrates a flow chart of operations depicting a method of operating a fuel nozzle, in accordance with an embodiment.

FIG. 5 illustrates a flow chart of operations depicting a method 100 of operating the fuel nozzle 6, in accordance with an embodiment. As shown at block 102 a step or operation can be implemented to accepting air and fuel separately in the inner mixing chamber and the outer mixing chamber located in the fuel nozzle 6. Next, as depicted at block 104, a step or operation can be implemented to combine the air and fuel to form a mixture of the air and the fuel, wherein the fuel can enter the inner mixing chamber through the first hole pattern formed in the fuel nozzle 6 and can enter the outer mixing chamber through the second hole pattern formed in the fuel nozzle 6.

Then, as indicated at block 106, a step or operation can be implemented to slow with the angled discharge included with the inner mixing chamber, the exit velocity of the mixture of the air and the fuel prior to exiting the fuel nozzle 6 through a discharge end of the fuel nozzle 6. As noted at block 108, the chambers together with the first hole pattern and the second hole pattern and the angled discharge can facilitate stabilization of a flame at two distinct points downstream of the fuel nozzle 6 depending on the rate of a flow of the fuel and the air.

Based on the foregoing, it can be appreciated that a number of different embodiments including preferred and alternative embodiments, are disclosed herein. For example, in an embodiment, a fuel nozzle can include: a plurality of chambers located in the fuel nozzle, wherein the plurality of chambers includes an inner mixing chamber and an outer mixing chamber, wherein the inner mixing chamber and the outer mixing chamber each accept air and fuel separately and combine the air and the fuel to form a mixture of the air and the fuel; a first hole pattern and a second hole pattern formed in the fuel nozzle, wherein the fuel enters the inner mixing chamber through the first hole pattern and enters the outer mixing chamber through the second hole pattern; and an angled discharge included with the inner mixing chamber, wherein the angled discharge slows an exit velocity of the mixture of the air and the fuel prior to exiting the fuel nozzle through a discharge end of the fuel nozzle, wherein the plurality of chambers together with the first hole pattern and the second hole pattern and the angled discharge facilitates stabilization of a flame at two distinct points downstream of the fuel nozzle depending on a rate of a flow of the fuel and the air.

In an embodiment, the outer mixing chamber can include a combination of spaces created between a plurality of vanes and an air housing.

In an embodiment, the plurality of vanes can be located at an angle from a long axis of a burner to generate a swirling flow at the discharge end of the fuel nozzle.

An embodiment can include a plurality of vanes located at an angle from a long axis of a burner to generate a swirling flow at the discharge end of the nozzle.

In an embodiment, the fuel can enter the fuel nozzle through a fuel inlet and can proceed to the inner mixing chamber where it can be distributed to the inner mixing chamber and outer mixing chamber simultaneously.

In an embodiment, the fuel can enter the inner mixing chamber through the first hole pattern in a desired amount and velocity.

In an embodiment, the fuel can enter the outer mixing chamber through the second hole pattern in a desired amount and velocity.

In an embodiment, the flame can be swirl stabilized downstream from the fuel nozzle.

In an embodiment, as the capacity of the fuel is reduced the flame can shift stabilization immediately downstream from the discharge end of the fuel nozzle.

In an embodiment, a fuel nozzle can include: a plurality of chambers located in the fuel nozzle, wherein the plurality of chambers includes an inner mixing chamber and an outer mixing chamber, wherein the inner mixing chamber and the outer mixing chamber each accept air and fuel separately and combine the air and the fuel to form a mixture of the air and the fuel; and an angled discharge included with the inner mixing chamber, wherein the angled discharge slows an exit velocity of the mixture of the air and the fuel prior to exiting the fuel nozzle through a discharge end of the fuel nozzle, wherein the plurality of chambers and the angled discharge facilitates stabilization of a flame at two distinct points downstream of the fuel nozzle depending on a rate of a flow of the fuel and the air.

In an embodiment, a first hole pattern and a second hole pattern can be configured from the fuel nozzle, such that the fuel can enter the inner mixing chamber through the first hole pattern and can enter the outer mixing chamber through the second hole pattern.

In an embodiment, a method of operating a fuel nozzle, can involve: accepting air and fuel separately in an inner mixing chamber and an outer mixing chamber of a plurality of chambers located in a fuel nozzle; combining the air and fuel to form a mixture of the air and the fuel, wherein the fuel enters the inner mixing chamber through a first hole pattern formed in the fuel nozzle and enters the outer mixing chamber through a second hole pattern formed in the fuel nozzle; and slowing with an angled discharge included with the inner mixing chamber, an exit velocity of the mixture of the air and the fuel prior to exiting the fuel nozzle through a discharge end of the fuel nozzle.

In an embodiment of the method, the plurality of chambers together with the first hole pattern and the second hole pattern and the angled discharge can facilitate stabilization of a flame at two distinct points downstream of the fuel nozzle depending on the rate of flow of the fuel and the air.

In an embodiment of the method, the outer mixing chamber can include a combination of spaces created between a plurality of vanes and an air housing.

In an embodiment of the method, the plurality of vanes can be located at an angle from a long axis of a burner to generate a swirling flow at the discharge end of the fuel nozzle.

An embodiment of the method can involve generating a swirling flow at the discharge end of the nozzle with a plurality of vanes located at an angle from a long axis of a burner.

In an embodiment of the method, the fuel can enter the fuel nozzle through a fuel inlet and can proceed to the inner mixing chamber where it can be distributed to the inner mixing chamber and outer mixing chamber simultaneously.

In an embodiment of the method, the fuel can enter the inner mixing chamber through the first hole pattern in a desired amount and velocity.

In an embodiment of the method, the fuel can enter the outer mixing chamber through the second hole pattern in a desired amount and velocity.

In an embodiment of the method, the flame can be swirl stabilized downstream from the fuel nozzle, and as the capacity of the fuel is reduced, the flame can shift stabilization immediately downstream from the discharge end of the fuel nozzle.

In the above description, specific details of various embodiments are provided. However, some embodiments may be practiced with less than all of these specific details. In other instances, certain methods, procedures, components, structures, and/or functions are described in no more detail than to enable the various embodiments, for the sake of brevity and clarity.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

It should also be noted that at least some of the operations for the methods described herein may be implemented using software instructions stored on a computer useable storage medium for execution by a computer. As an example, an embodiment of a computer program product includes a computer useable storage medium to store a computer readable program.

The computer-useable or computer-readable storage medium can be an electronic, magnetic, optical, electromagnetic, infrared, or semiconductor system (or apparatus or device). Examples of non-transitory computer-useable and computer-readable storage media include a semiconductor or solid state memory, magnetic tape, a removable computer diskette, a random access memory (RAM), a read-only memory (ROM), a rigid magnetic disk, and an optical disk. Current examples of optical disks include a compact disk with read only memory (CD-ROM), a compact disk with read/write (CD-R/W), and a digital video disk (DVD).

Alternatively, embodiments may be implemented entirely in hardware or in an implementation containing both hardware and software elements. In embodiments which use software, the software may include but is not limited to firmware, resident software, microcode, etc.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A fuel nozzle, comprising:

a plurality of chambers located in the fuel nozzle, wherein the plurality of chambers includes an inner mixing chamber and an outer mixing chamber, wherein the inner mixing chamber and the outer mixing chamber each accept air and fuel separately and combine the air and the fuel to form a mixture of the air and the fuel;

a first hole pattern and a second hole pattern formed in the fuel nozzle, wherein the fuel enters the inner mixing chamber through the first hole pattern and enters the outer mixing chamber through the second hole pattern; and an angled discharge included with the inner mixing chamber, wherein the angled discharge slows an exit velocity of the mixture of the air and the fuel prior to exiting the fuel nozzle through a discharge end of the fuel nozzle, wherein the plurality of chambers together with the first hole pattern and the second hole pattern and the angled discharge facilitates stabilization of a flame at two distinct points downstream of the fuel nozzle depending on a rate of a flow of the fuel and the air; and wherein the fuel enters the fuel nozzle through a fuel inlet and proceeds to the inner mixing chamber where the fuel is distributed to the inner mixing chamber and outer mixing chamber simultaneously.

2. The fuel nozzle of claim 1 wherein the outer mixing chamber comprises a combination of spaces created between a plurality of vanes and an air housing.

3. The fuel nozzle of claim 2 wherein the plurality of vanes are located at an angle from a long axis of a burner to generate a swirling flow at the discharge end of the fuel nozzle.

4. The fuel nozzle of claim 1 further comprising a plurality of vanes located at an angle from a long axis of a burner to generate a swirling flow at the discharge end of the nozzle.

5. The fuel nozzle of claim 1 wherein the fuel enters the inner mixing chamber through the first hole pattern in a desired amount and velocity.

6. The fuel nozzle of claim 1 wherein the fuel enters the outer mixing chamber through the second hole pattern in a desired amount and velocity.

7. The fuel nozzle of claim 1 wherein the flame is swirl stabilized downstream from the fuel nozzle.

8. The fuel nozzle of claim 1 wherein as a capacity of the fuel is reduced the flame shifts stabilization immediately downstream from the discharge end of the fuel nozzle.

9. A fuel nozzle, comprising:

a plurality of chambers located in the fuel nozzle, wherein the plurality of chambers includes an inner mixing chamber and an outer mixing chamber, wherein the inner mixing chamber and the outer mixing chamber each accept air and fuel separately and combine the air and the fuel to form a mixture of the air and the fuel; and an angled discharge included with the inner mixing chamber, wherein the angled discharge slows an exit velocity of the mixture of the air and the fuel prior to exiting the fuel nozzle through a discharge end of the fuel nozzle, wherein the plurality of chambers and the angled discharge facilitates stabilization of a flame at two distinct points downstream of the fuel nozzle depending on a rate of a flow of the fuel and the air; and wherein the fuel enters the fuel nozzle through a fuel inlet and proceeds to the inner mixing chamber where the fuel is distributed to the inner mixing chamber and outer mixing chamber simultaneously.

10. The fuel nozzle of claim 9 further comprising:

a first hole pattern and a second hole pattern configured from the fuel nozzle, wherein the fuel enters the inner mixing chamber through the first hole pattern and enters the outer mixing chamber through the second hole pattern.

11. A method of operating a fuel nozzle, comprising:

accepting air and fuel separately in an inner mixing chamber and an outer mixing chamber of a plurality of chambers located in a fuel nozzle;

combining the air and fuel to form a mixture of the air and the fuel, wherein the fuel enters the inner mixing chamber through a first hole pattern formed in the fuel nozzle and enters the outer mixing chamber through a second hole pattern formed in the fuel nozzle; and slowing with an angled discharge included with the inner mixing chamber, an exit velocity of the mixture of the air and the fuel prior to exiting the fuel nozzle through a discharge end of the fuel nozzle wherein the fuel enters the fuel nozzle through a fuel inlet and proceeds to the inner mixing chamber where the fuel is distributed to the inner mixing chamber and outer mixing chamber simultaneously.

12. The method of claim 11 wherein the plurality of chambers together with the first hole pattern and the second hole pattern and the angled discharge facilitates stabilization of a flame at two distinct points downstream of the fuel nozzle depending on a rate of a flow of the fuel and the air.

13. The method of claim 12 wherein the plurality of vanes are located at an angle from a long axis of a burner to generate a swirling flow at the discharge end of the fuel nozzle.

14. The method of claim 11 wherein the outer mixing chamber comprises a combination of spaces created between a plurality of vanes and an air housing.

15. The method of claim 11 generating a swirling flow at the discharge end of the nozzle with a plurality of vanes located at an angle from a long axis of a burner.

16. The method of claim 11 wherein the fuel enters the inner mixing chamber through the first hole pattern in a desired amount and velocity.

17. The method of claim 11 wherein the fuel enters the outer mixing chamber through the second hole pattern in a desired amount and velocity.

18. The method claim 11 wherein:

the flame is swirl stabilized downstream from the fuel nozzle; and as a capacity of the fuel is reduced the flame shifts stabilization immediately downstream from the discharge end of the fuel nozzle.

* * * * *